US007427239B2

(12) United States Patent
Hocknell et al.

(10) Patent No.: US 7,427,239 B2
(45) **Date of Patent: *Sep. 23, 2008**

(54) GOLF CLUB WITH INTERCHANGEABLE HEAD-SHAFT CONNECTION

(75) Inventors: Alan Hocknell, Carlsbad, CA (US); Matthew T. Cackett, San Diego, CA (US); Denver Holt, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/461,227

(22) Filed: Jul. 31, 2006

(65) Prior Publication Data

US 2006/0281575 A1 Dec. 14, 2006

Related U.S. Application Data

(63) Continuation-in-part of application No. 10/904,581, filed on Nov. 17, 2004, now Pat. No. 7,083,529.

(51) Int. Cl.
*A63B 53/02* (2006.01)

(52) U.S. Cl. ..... 473/307; 473/309

(58) Field of Classification Search ..... 473/307–310, 473/288, 315, 294, 296, 298, 299; 403/355, 403/364, 375

See application file for complete search history.

(56) References Cited

U.S. PATENT DOCUMENTS

| | | | | | |
|---|---|---|---|---|---|
| 3,524,646 | A * | 8/1970 | Wheeler | 473/288 |
| 4,664,382 | A * | 5/1987 | Palmer et al. | 473/288 |
| 4,943,059 | A * | 7/1990 | Morell | 473/306 |
| 5,588,921 | A * | 12/1996 | Parsick | 473/299 |
| 6,416,415 | B1 * | 7/2002 | Yu | 464/42 |
| 6,890,269 | B2 * | 5/2005 | Burrows | 473/307 |
| 2001/0007835 | A1 * | 7/2001 | Baron | 473/305 |
| 2004/0018887 | A1 * | 1/2004 | Burrows | 473/307 |
| 2005/0049072 | A1 * | 3/2005 | Burrows | 473/305 |

* cited by examiner

*Primary Examiner*—Stephen L. Blau
(74) *Attorney, Agent, or Firm*—Michael A. Catania; Elaine H. Lo

(57) ABSTRACT

A golf club (20) having a club head (22) with an interchangeable shaft (40) is disclosed herein. The golf club (20) includes a tube (144) mounted in the club head (22), and a sleeve (146) mounted on a tip end (50) of the shaft (40). An exterior bottom end of the sleeve (146) has a castellated surface. An interior bottom end of the tube (144) has a matching castellated surface. The golf club (20) further includes a mechanical fastener (148) for removably securing the shaft (40) to the club head (22).

13 Claims, 5 Drawing Sheets

GOLF CLUB WITH INTERCHANGEABLE HEAD-SHAFT CONNECTION

CROSS REFERENCE TO RELATED APPLICATIONS

The Present application is a continuation-in-part of U.S. patent application Ser. No. 10/904,581 filed on Nov. 17, 2004 now U.S. Pat. No. 7,083,529.

STATEMENT REGARDING FEDERALLY SPONSORED RESEARCH OR DEVELOPMENT

Not Applicable

BACKGROUND OF THE INVENTION

1. Field of the Invention

The present invention relates to a golf club having an improved connection for interchanging a shaft with a golf club head.

2. Description of the Related Art

In order to improve their game, golfers often customize their equipment to fit their particular swing. Golf equipment manufacturers have responded by increasing the variety of clubs available to golfers. For example, a particular model of a driver-type golf club may be offered in several different loft angles and lie angles to suit a particular golfer's needs. In addition, golfers can choose shafts, whether metal or graphite, and adjust the length of the shaft to suit their swing. Golf clubs that allow shaft and club head components to be easily interchanged facilitate this customization process.

One example is Wheeler, U.S. Pat. No. 3,524,646 for a Golf Club Assembly. The Wheeler patent discloses a putter having a grip and a putter head, both of which are detachable from a shaft. Fastening members, provided on the upper and lower ends of the shaft, have internal threads, which engage the external threads provided on both the lower end of the grip and the upper end of the putter head shank to secure these components to the shaft. The lower portion of the shaft further includes a flange, which contacts the upper end of the putter head shank, when the putter head is coupled to the shaft.

Another example is Walker, U.S. Pat. No. 5,433,442 for Golf Clubs with Quick Release Heads. The Walker patent discloses a golf club in which the club head is secured to the shaft by a coupling rod and a quick release pin. The upper end of the coupling rod has external threads that and engage the internal threads formed in the lower portion of the shaft. The lower end of the coupling rod, which is inserted into the hosel of the club head, has diametric apertures that align with diametric apertures in the hosel to receive the quick release pin.

Still another example is Roark, U.S. Pat. No. 6,547,673 for an Interchangeable Golf Club Head and Adjustable Handle System. The Roark patent discloses a golf club with a quick release for detaching a club head from a shaft. The quick release is a two-piece connector including a lower connector, which is secured in the hosel of the club head, and an upper connector, which is secured in the lower portion of the shaft. The upper connector has a pin and a ball catch that protrude radially outward from the lower end of the upper connector. The upper end of the lower connector has a slot formed therein for receiving the upper connector pin, and a separate hole for receiving the ball catch. When the shaft is coupled to the club head, the lower connector hole retains the ball catch to secure the shaft to the club head.

Two further examples are published applications to Burrows, U.S. Pub. Nos. 2004/0018886 and 2004/0018887, both of which are for a Temporary Golf Club Shaft-Component Connection. The Burrows applications disclose a temporary connection that includes an adapter insert, a socket member, and a mechanical fastener. The adapter insert, which is mounted on a shaft, includes a thrust flange. The socket member, which is mounted on the other golf club component (e.g., a club head), includes a thrust seat for seated reception of the thrust flange. The mechanical fastener (e.g., a compression nut or a lock bolt) removably interconnects the adapter insert and the socket member.

The prior art temporary head-shaft connections have several disadvantages. First, they require that the golf club head have a conventional hosel for attachment. Second, these connections add excessive weight to the club head, thereby minimizing the amount of discretionary mass that may be distributed in the club head to optimize mass properties. Third, the prior art connections offer small, faying surfaces for centering and reacting to bending moments.

BRIEF SUMMARY OF THE INVENTION

The present invention provides an improved club head-shaft connection for cost-effective customization of golf clubs, while providing golfers with golf clubs that provide optimal performance. The connection, which does not require the club head to have a conventional hosel, enables quick and reliable assembly and disassembly of a shaft from the club head. In addition, the head-shaft connection of the present golf club provides a larger faying surface between the components without adding excessive weight. The reduced weight of the present connection enables more discretionary mass to be distributed to favorable locations in the club head to enhance its performance.

One aspect of the present invention is a golf club including a club head, a tube, a shaft, a sleeve and a mechanical fastener. The tube is mounted in the club head and the sleeve is mounted on a tip end of the shaft, which is then inserted into the tube. An exterior bottom end of the sleeve has a castellated surface which is mated with a corresponding surface on the interior bottom end of the tube. The castellated surface prevents rotation of the shaft.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
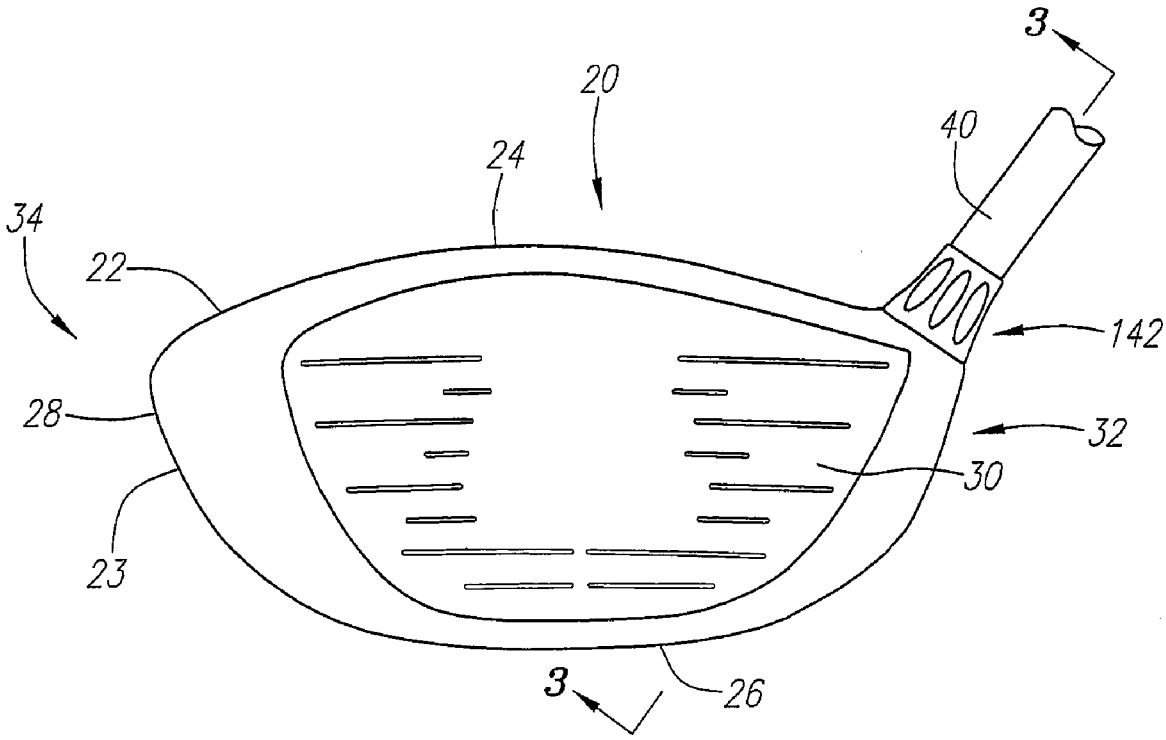
FIG. 1 is a front plan view of a golf club in accordance with one embodiment of the present invention.
Figure 2:
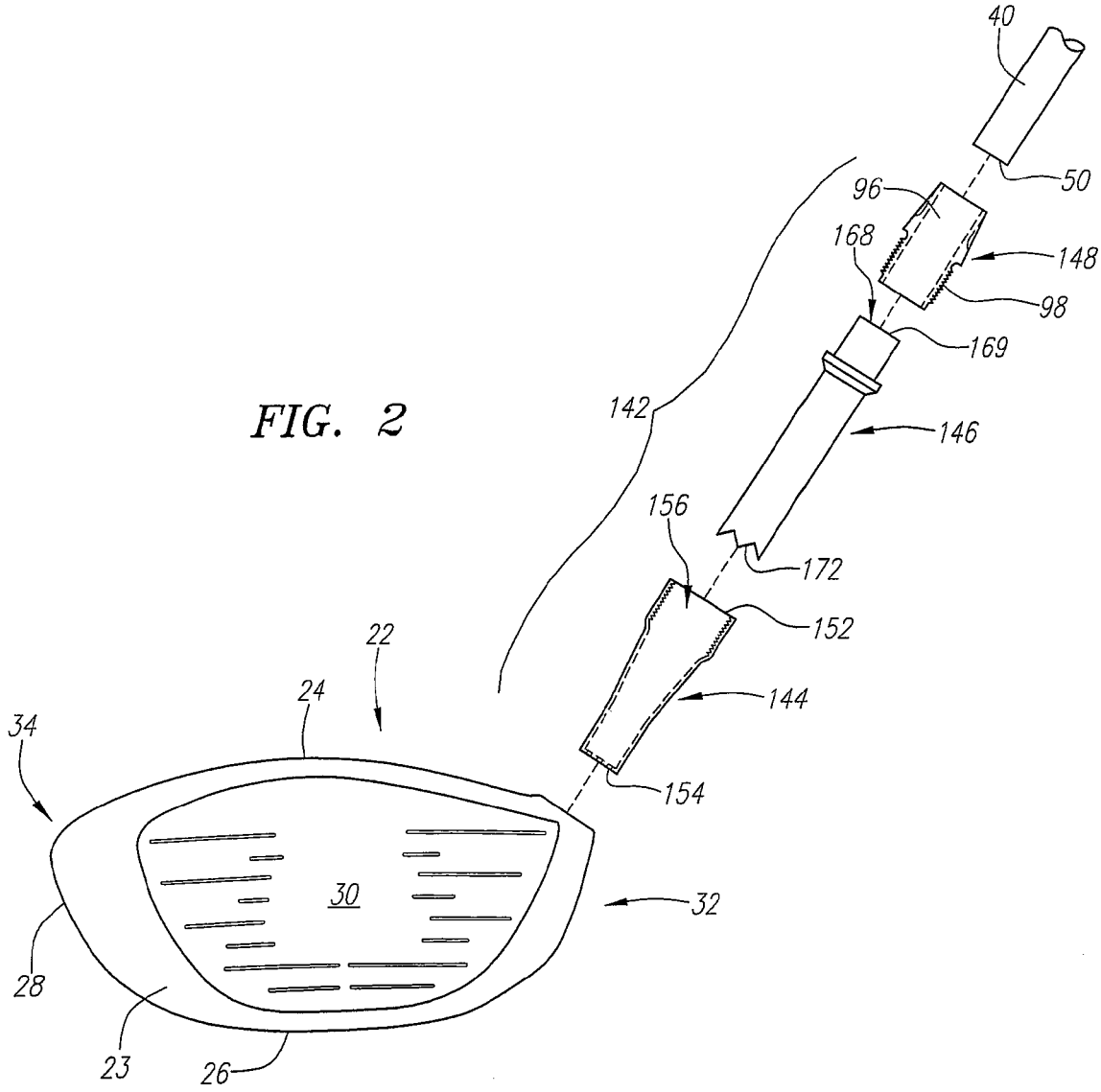
FIG. 2 is an exploded perspective view of a portion of a golf club in accordance with another embodiment of the present invention.

As shown in FIGS. 1 and 2, a golf club is generally designated 20. The golf club 20 has a club head 22 and a shaft 40 that is coupled to the club head 22. The club head 22 is preferably a wood-type golf club head with a body 23 having a crown, 24, a sole 26, a ribbon 28 and a striking plate 30. The striking plate 30 generally extends along the front of the club head 22 from a heel end 32 to a toe end 34. The club head body 23 preferably has a hollow interior with an internal hosel 31 (FIG. 3) for receiving the tip end of the shaft 40. Alternatively, the club head has an external hosel that extends upward from the crown 24.

The body 23 is preferably composed of a metallic material, such as titanium, titanium alloy, stainless steel, or the like. Alternatively, the body 23 may be composed of multiple materials, such as a titanium face cup attached to a carbon composite body. The body 23 has a large volume, preferably greater than 300 cubic centimeters, and weighs no more than 215 grams, more preferably between 180 and 215 grams. Although the club head 22 illustrated is a wood-type club head, the club head 22 may also be an iron-type or putter-type club head.

The shaft 40 is preferably composed of a graphite material, however, it may be composed of a metallic material, such as stainless steel or titanium. Alternatively, the shaft 40 may be composed of a hybrid of graphite and metal. The shaft 40 preferably weighs between 40 grams and 80 grams, more preferably between 50 grams and 75 grams, and is most preferably 65 grams.

The shaft 40 is coupled to the club head 22 using a connection 142 that provides for easy assembly, disassembly and reassembly, thereby facilitating customization of the golf club 20.

FIGS. 2-5 illustrate a golf club with a connection 142 for joining a shaft 40 to a club head 22. The connection 142 includes a tube 144, a sleeve 146 and a mechanical fastener 148. The mechanical fastener 148 is preferably a compression nut 96 having external threads 98. The compression nut 96 and the sleeve 146 are placed on the shaft 40, with the sleeve 146 mounted on the tip end 50 and secured thereto with an adhesive, such as epoxy. The shaft 40 with the sleeve 146 and compression nut 96 thereon is then inserted into the tube 144, which is mounted in the club head 22. The compression nut 96 is then tightened to engage the tube 144, thereby securing the sleeve 146 inbetween and connecting the shaft 40 to the club head 22.

The tube 144 is preferably composed of a metallic material, such as aluminum or titanium, but may also be composed of a suitable non-metallic material. The tube 144 is secured in the internal hosel 31 of the club head 22 using an adhesive, such as epoxy. The tube 144 preferably has an upper end 152 that extends above the crown surface 24 of the club head 22. Alternatively, the upper end 152 of the tube 144 may be flush with the crown surface 24. An opening 156 extends along a majority of the length of the tube 144 from the upper end 152 toward a lower end 154. The lower end 154 of the tube 144, however, is closed. The inner diameter $D_1$ of the upper end 152 of the tube 144 is greater than the inner diameter $D_2$ at the lower end 154.

Figure 4:
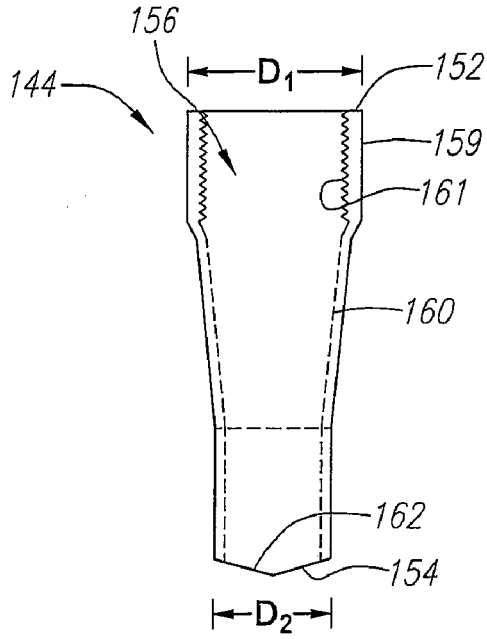
FIG. 4 is an enlarged cross-sectional view of the tube shown in FIG. 2.

The tube 144, as illustrated in FIG. 4, includes a connection portion 159, a tapered portion 160 and a castellated internal surface 162. The connection portion 159 is located proximate the upper end 152 of the tube 144 and has internal threads 161 for engaging the external threads 98 of the compression nut 96. Because the threads 161 of tube 144 are internal, the threads 161 are protected from damage that may occur during storage, manufacture, or customization of the golf club 20.

The tapered portion 160, which provides a contact surface for receiving the sleeve 146, is located below the connection portion 159. The castellated internal surface 162 is located at the lower end 154 of the tube 144 and defines a surface for mating with a corresponding castellated external surface 172 of the sleeve 146. The castellated surfaces 162 and 172 prevent rotation of the sleeve 146 relative to the tube 144.

Figure 6:
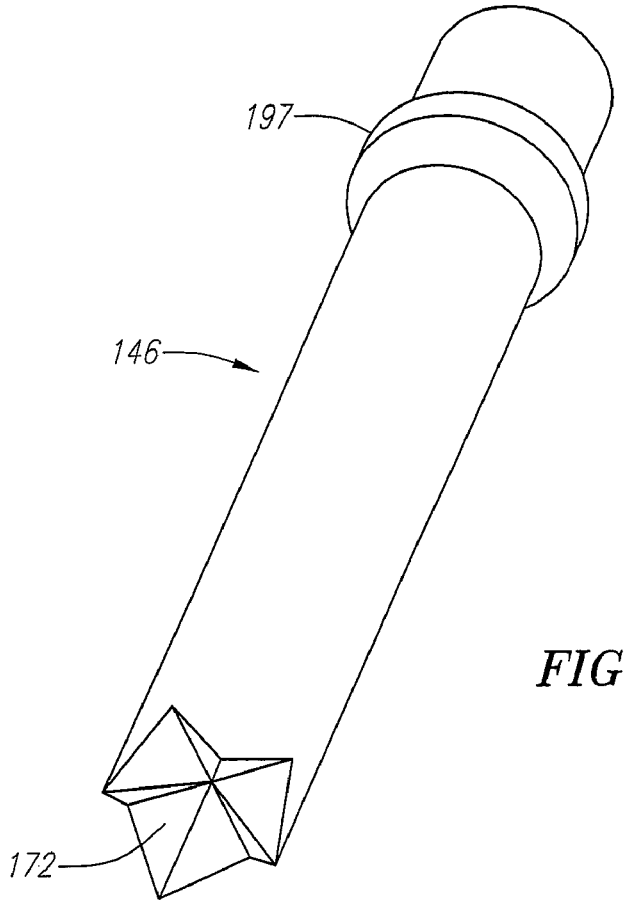
FIG. 6 is an isolated view of an embodiment of a sleeve.
Figure 6A:
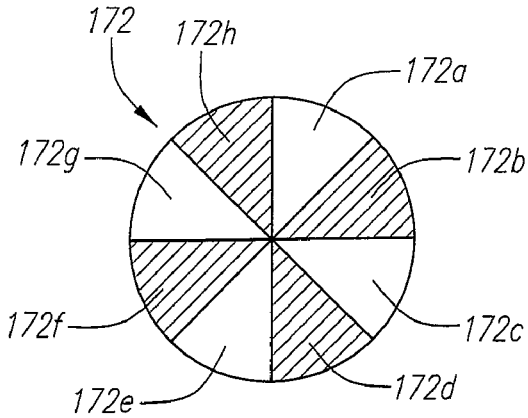
FIG. 6A is a plan view of the castellated exterior surface of the sleeve of FIG. 6.
Figure 6B:
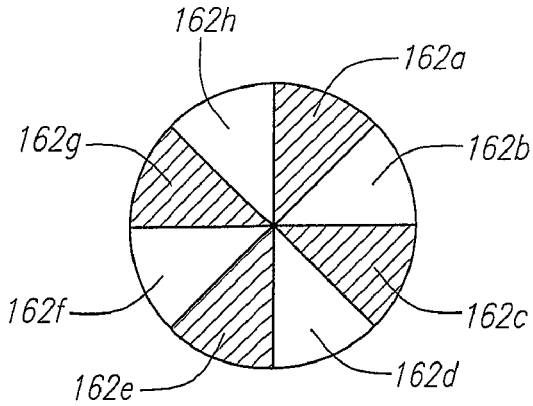
FIG. 6B is a plan view of a castellated interior surface of a tube that corresponds to the castellated exterior surface of the sleeve of FIG. 6A.

As shown in FIGS. 6 and 6A, one embodiment of the sleeve 146 has a castellated external surface 172 composed of alternating facets 172*a*-172*h*. The alternating facets preferably range from 4 to 32, and more preferably from 6 to 16, and most preferably 8 facets as shown. As shown in FIG. 6B, the castellated internal surface 162 of the tube 144 has a surface 162 that corresponds and mates with the surface 172 of the sleeve 144. Castellated internal surface 162 is preferably composed of alternating facets 162*a*-162*h*. The alternating facets preferably range from 4 to 32, and more preferably from 6 to 16, and most preferably 8 facets as shown.

Figure 7:
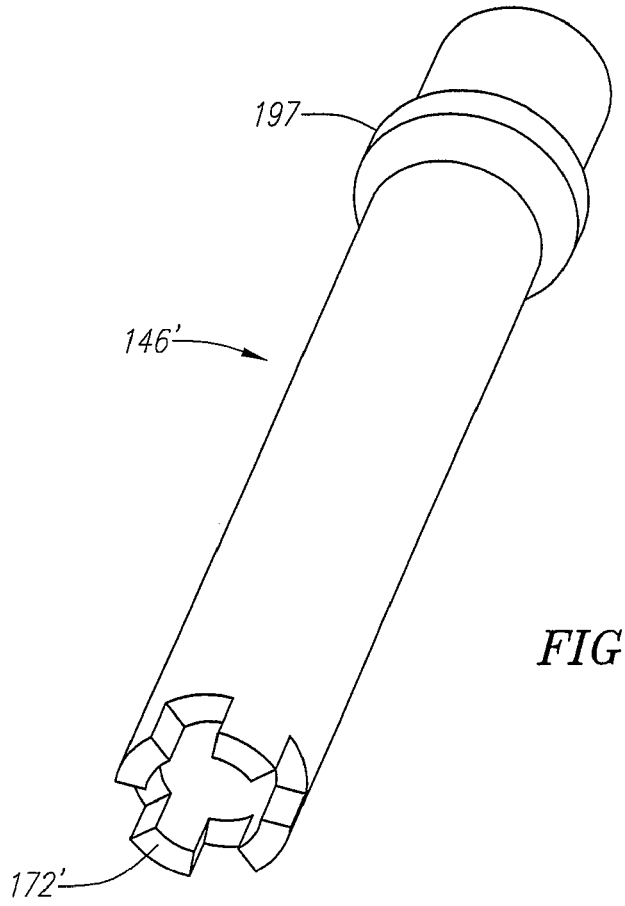
FIG. 7 is an isolated view of an embodiment of a sleeve.
Figure 7A:
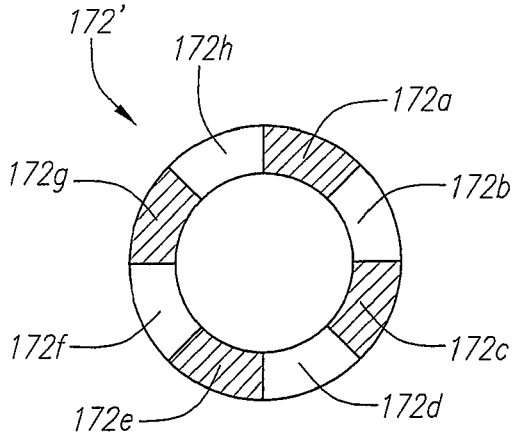
FIG. 7A is a plan view of the castellated exterior surface of the sleeve of FIG. 7.
Figure 7B:
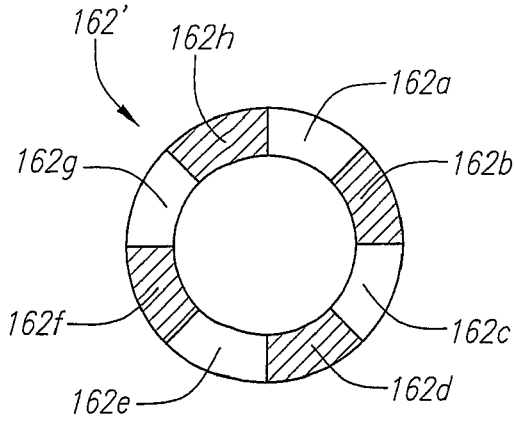
FIG. 7B is a plan view of a castellated interior surface of a tube that corresponds to the castellated exterior surface of the sleeve of FIG. 7A.

An alternative castellated external surface 172' for the sleeve is show in FIGS. 7 and 7A. This embodiment has a plurality of alternating teeth and grooves 172*a*-*h*. The alternating teeth and grooves preferably range from 4 to 32, and more preferably from 6 to 16, and most preferably 8 facets as shown. As shown in FIG. 7B, the castellated internal surface 162' of the tube 144 has a surface 162' that corresponds and mates with the surface 172' of the sleeve 144. Castellated internal surface 162' is preferably composed of alternating teeth and grooves 162*a*-162*h*. The alternating teeth and grooves preferably range from 4 to 32, and more preferably from 6 to 16, and most preferably 8 facets as shown.

The sleeve 146 and tip of the shaft 40 also preferably have a reduced diameter for reducing the mass of the connection 142. Typically, shaft tip diameters range from 0.335 inch to 0.370 inch, and are sometimes 0.400 inch in outer diameter. The sleeve 146 preferably has a thickness of 0.015 inch or less for a sleeve 146 outer diameter that is not more than 0.030 inch greater than the outer diameter of the shaft 40.

The sleeve 146 also preferably has a compliant washer 197 for engaging the compression nut 96.

Figure 5:
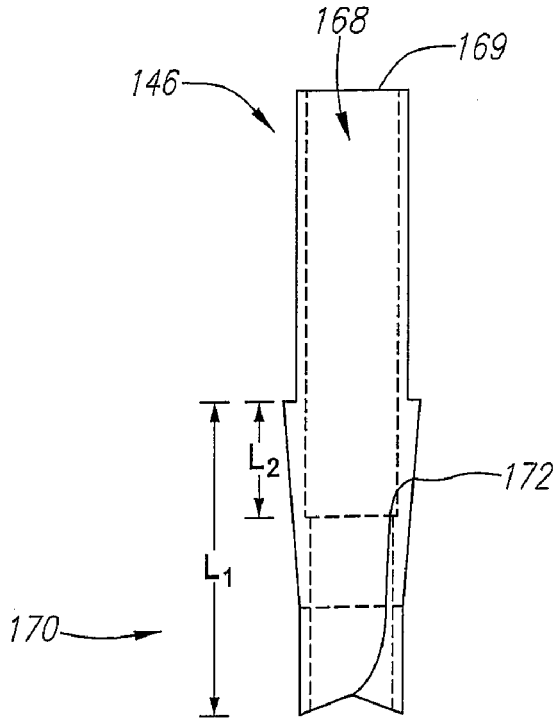
FIG. 5 is an enlarged cross-sectional view of the sleeve shown in FIG. 2.

The sleeve 146 is illustrated in FIG. 5. The sleeve has an opening 168 formed in an upper end 169 thereof for receiving the tip end 50 of the shaft 40. The sleeve is fixedly secured to the shaft 40 using an adhesive, such as epoxy. The sleeve 146 has an exterior bottom end 170 that has a castellated external surface 172. The castellated surface 172 prevents rotation of the shaft when the shaft 40 is connected to the club head 22.

Figure 3:
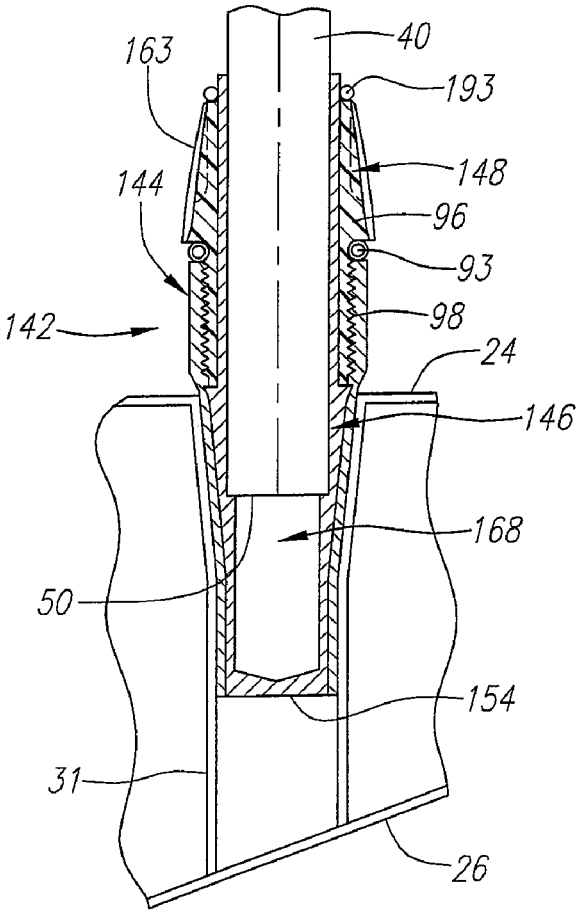
FIG. 3 is an enlarged cross-sectional view of the golf club of FIG. 2.

The golf club illustrated in FIGS. 2 and 3 is assembled by permanently securing the tube 144 to the club head 22. Next, the compression nut 96 is placed over the tip end 50 of the shaft 40. The sleeve 146 is then permanently secured to the tip end 50 of the shaft 40. The tip end 50 of the shaft 40, carrying the sleeve 146 and the compression nut 96, is then inserted into the opening 156 in the tube 144, such that the castellated external surface 172 of the sleeve 146 engages the castellated internal surface 162 of the tube 144 to prevent rotation. The external threads 98 of the compression nut 96 are then engaged with the internal threads 161 of the connection portion 159 of the tube 144 to secure the shaft 40 to the club head 22.

The tube 144 and the sleeve 146 are preferably composed of lightweight materials that do not add unnecessary weight to the golf club.

The golf club may further include a sealing gasket 93 located between the compression nut 96 and the upper end 152 of the tube 144 to prevent water and other contaminants from entering the connection 142. A second gasket 193 may also be provided between the top of the compression nut 96 and the upper end 169 of the sleeve 146 for aesthetic purposes.

When a suitable head and shaft combination is achieved, the connection 142 may be made more permanent, by applying a cover 163 over the exposed portion of the compression nut 96. The cover 163 is preferably a thin sheath of rubber or elastomeric material that encloses the indents on the compression nut 96, making the compression nut 96 inaccessible to the average golfer. The cover 163 may be integral with the sealing gaskets 93 and 193 or separate. The connection 142 may also be made more permanent by extending the lower edge of the head of the compression nut 96 over the sealing gasket 93 to overlap the outer wall of the upper end 152 of the tube 144, and applying a bead of adhesive at the overlap. Local application of heat to this joint by a skilled golf repair technician would enable the compression nut 96 to be separated from the tube 144 and a different shaft to be combined with the club head.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:

a club head;

a shaft having a tip end and a butt end;

a sleeve mounted on the tip end of the shaft, an exterior bottom end of the sleeve having a castellated surface;

a tube mounted in the club head, the tube having an upper end with an inner diameter larger than an inner diameter at a lower end of the tube, the tube having an interior bottom end with a reciprocal castellated surface to the castellated surface of the sleeve to prevent rotation of the shaft; and a mechanical fastener removably securing the sleeve to the tube.

2. The golf club according to claim 1 wherein the upper end of the tube is substantially flush with an exterior crown surface of the club head.

3. The golf club according to claim 1 wherein the upper end of the tube extends above an exterior crown surface of the club head.

4. The golf club according to claim 1 wherein each of the tube and the sleeve is composed of a metallic material.

5. The golf club according to claim 1 wherein the sleeve has an outer diameter not more than 0.030 inch greater than the outer diameter of the tip end of the shaft.

6. The golf club according to claim 1 wherein the castellated surface of the exterior bottom end of the sleeve comprises eight facets.

7. The golf club according to claim 1 further comprising an adhesive between the mechanical fastener and the tube, the adhesive preventing removal of the mechanical fastener.

8. The golf club according to claim 1 wherein the club head includes a hosel, the tube being mounted in the hosel.

9. The golf club according to claim 1 wherein the mechanical fastener is a compression nut having external threads, and an upper portion of the tube has internal threads for engaging the external threads of the compression nut.

10. The golf club according to claim 1 wherein the lower end of the tube is open and aligned with an opening in a sole portion of the club head.

11. The golf club according to claim 1 wherein the castellated surface of the exterior bottom end of the sleeve comprises six facets.

12. A golf club comprising:

a club head;

a shaft having a tip end and a butt end, the tip end having an outer diameter not more than 0.400 inch;

a metallic sleeve mounted on the tip end of the shaft, an exterior bottom end of the metallic sleeve having a castellated surface, the metallic sleeve having an outer diameter not more than 0.030 inch greater than the outer diameter of the tip end of the shaft;

a metallic tube mounted in the club head, the metallic tube having an upper end with an inner diameter larger than an inner diameter at a lower end of the metallic tube, the metallic tube having an interior bottom end with a reciprocal castellated surface to the castellated surface of the sleeve to prevent rotation of the shaft; and a mechanical fastener removably securing the metallic sleeve to the metallic tube.

13. The golf club according to claim 12 wherein the castellated surface of the exterior bottom end of the sleeve comprises six facets or eight facets.

* * * * *